US005640876A

United States Patent [19]

Erwin

[11] Patent Number: 5,640,876

[45] Date of Patent: Jun. 24, 1997

[54] LOCKING PLIERS PULLING SYSTEM

[76] Inventor: Freddie B. Erwin, 1928 S. Main, Malvern, Ark. 72104

[21] Appl. No.: 562,049

[22] Filed: Nov. 22, 1995

[51] Int. Cl.[6] ..... B21D 1/12

[52] U.S. Cl. ..... 72/422; 72/705; 294/28; 294/132

[58] Field of Search ..... 72/290, 308, 422, 72/705; 24/132 R, 132 WL; 81/367, 368; 294/28, 30, 104, 132

[56] References Cited

U.S. PATENT DOCUMENTS

| | | | |
|---|---|---|---|
| 2,627,774 | 2/1953 | Walter | 81/368 |
| 3,696,653 | 10/1972 | Mojelski | 72/705 |
| 3,878,709 | 4/1975 | Chartier | 72/705 |
| 4,748,842 | 6/1988 | Dingman | 72/705 |

*Primary Examiner*—Lowell A. Larson
*Attorney, Agent, or Firm*—Jerry L. Mahurin

[57] ABSTRACT

A locking pliers pulling system for tensioning or hanging a workpiece comprises a set locking pliers to be secured to the workpiece linked to a pulling device via an adapter. The adapter is threaded into the hollow adjustment barrel of a set of locking pliers of the type commonly referred to as Vise Grips®. The puller adapter is an integral component comprising a threaded, elongated shank portion, coaxial follower portion and a coaxial eye portion. The shank is adapted to screw into the adjustment barrel of the locking pliers. The follower portion extends from a first end of the shank portion to engage the locking link of the pliers, within the adjustment barrel. The eye portion extends from an opposite end of the shank portion to mate with a puller. The puller may be a winch, cable puller of the type commonly referred to as a "come-along", a slide hammer or the like. The eye promotes self centering of the link between the puller to the pliers. The eye may be oval or may define a narrowing slot. A narrowing slot also promotes self securing. An alternative embodiment allows the eye portion to coaxially swivel relative to the shank portion.

20 Claims, 3 Drawing Sheets

LOCKING PLIERS PULLING SYSTEM

BACKGROUND OF THE INVENTION

The present invention broadly relates to hand tools. Specifically, the present invention is a pulling system intended to be employed with locking pliers such as those commonly known as Vise-Grips®. Art pertinent to the subject matter of the present invention can be found in U.S. Patent Class 81, Subclasses 427 and 84.

Over the years, locking pliers or Vise-Grips® have proven to be very versatile tools. Their primary use is to actively grip an object such as a nut or the head of a bolt or screw, allowing the operator to concentrate his or her strength on twisting the nut, bolt or screw. Likewise items such as slide hammers and cable pullers have provided craftsmen, especially in automotive body work, a proven means to transfer tension to a sheet metal workpiece.

As one would expect, numerous parents have been issued on locking pliers designs. Petersen, U.S. Pat. No. 1,489,458, issued Apr. 8, 1924, is a very early example. Many improvements have also received patent protection. Some concern operation of the pliers' mechanism, such as Kash, U.S. Pat. No. 2,489,895. Petersen, U.S. Pat. No. 2,641,149, is an early "C-clamp" design. Helms, U.S. Pat. No. 3,793,914, replaces the conventional adjustment screw with a dog and tooth arrangement.

Many patents have also issued on modifications which render conventional locking pliers specialized tools. Most modifications are to the jaw structure. For example, Dyer, U.S. Pat. No. 2,328,433, is an electrode tip tool for spot welders; Lowther, U.S. Pat. No. 4,982,631, a tubing plug; Green, U.S. Pat. No. 4,829,875, a sheet metal abutment clamp; Shea, U.S. Pat. No. 5,168,783, a cable clamp; and Bush, U.S. Pat. No. 5,143,359, a plastic gripping member to be attached to a "C-clamp" locking pliers.

Other attachments are associated with the handle portion of the locking pliers. Smith, U.S. Pat. No. 5,280,892, discloses a motor driven system for positioning pieces to be welded. It uses a pair of locking pliers as jaws. Morrison, U.S. Pat. No. 4,889,021, discloses a security locking system for locking pliers. A system for remotely operating a set of locking pliers is disclosed in Gowers, U.S. Pat. No. 4,462,284. Seashore, U.S. Pat. No. 2,385,654, discloses a handle design employing a larger knob to operate a set of locking pliers. Teramo, U.S. Pat. No. 4,738,017 discloses a modification of both the handle and the jaw portion of a set of locking pliers to provide a parking brake cable tool. Heldt, U.S. Pat. No. 4,519,278, discloses a brace extension (speed wrench) adapter for a set of locking pliers. Trusty, U.S. Pat. No. 3,253,850, discloses a handle extending from a set of locking pliers to provide a means to use the locking pliers as a lifting tool. Lance, U.S. Pat. No. 4,297,756, discloses a "ball-joint" adapter fitted to the head of the adjustment screw of a set of locking pliers. This adapter is intended to support a camera or similar article.

Conventional or "channel-lock" pliers are also the subject of modifications to allow them to perform a wider range of tasks. Finn, U.S. Pat. No. 5,119,520, discloses a combination tool which adds a screwdriver bit and/or a socket adapter to the end of a set of plier handles. A tool extender in the form of a socket adapter for a pair of channel locks is disclosed in Ball, U.S. Pat. No. 4,738,167. Another tool extender is disclosed in Grau, U.S. Pat. No. 2,237,427. Another handle extender is disclosed in Berkich, U.S. Pat. No. 4,793,225.

These prior art devices fail to combine the versatility of a set of locking pliers with the often necessary tensioning or pulling force provided by a slide hammer or cable puller. For instance it is common practice in the auto body industry to drill holes in a sheet metal body part to thread a screw into the metal. A slide hammer is then attached to the screw and used to "pull" the metal into position. Similarly such a screw can be an anchoring point for a cable puller to facilitate positioning the sheet metal. The cable puller provides the advantage of allowing the metal to be slowly tensioned or to be pulled into position for welding. However, it is difficult to anchor the hook of a cable puller to the sheet metal. If tension is to be provided near an edge, a hook positioned over the edge is likely to slide, misdirecting the tension being applied. To anchor the puller in the center of a panel is even more problematic. To provide a point to which to secure the hook of a conventional puller would require one to screw a rather large eye-bolt or similar article into a hole in the panel. This requires drilling an impractically large hole in the panel.

Hence it is desirable to provide a convenient means to transfer tension from a puller to a sheet metal edge or panel. Additionally, it is desirable to provide a means to transfer tension from a puller or slide hammer to the center of a panel without requiring holes be drilled in the panel.

SUMMARY OF THE INVENTION

My pulling system for locking pliers provides a convenient coupling between a pulling device and a workpiece. It allows a cable puller or similar device to be quickly and easily attached to an edge of a sheet metal workpiece. Also, my device can be locked onto a screw threaded into the center of a sheet metal panel allowing a cable puller or similar tool to provide slow steady tension to the panel. Alternatively, a tab can be attached (spot welded) to the panel and my pulling system secured to the tab, allowing the panel to be worked without drilling a hole in it. Finally, my system provides a convenient method to hang workpieces for ready retrieval or storage.

The preferred embodiment of my a pulling system comprises a tensioning device secured to a set of locking pliers. A hook or shackle associated with the tensioning device engages an eye portion of an adapter extending from the locking pliers. The tensioning device can be of the type commonly referred to as a "come-along", a stationary winch or a slide hammer.

The adapter comprises an elongated, threaded shank portion, a coaxial follower portion and a coaxial eye portion. The shank is screwed into the adjustment barrel of a set of locking pliers, replacing the conventional adjusting screw. The follower engages the adjusting pliers' locking link within the adjustment barrel. The eye of the adapter protrudes from the proximal end of the stationary handle of the locking pliers. The opening defined by the eye of the preferred adapter embodiment is generally oval. The hook will slide to the center of the proximal portion of the eye and self-center as tension is applied by the puller.

As mentioned above, my system can be used to easily hang workpieces for ready retrieval or storage. For example, in an assembly line setting, the locking plier jaws can be easily clamped onto the edge of a sheet metal workpiece such as an auto body part and, the eye of the adapter hung from a suspended hook. The part can be readily retrieved, using only one hand to release the locking pliers.

Alternative embodiments of the adapter employ different eye configurations. Specifically the eye may define an elliptical opening or a narrowing slot. The elliptical eye more securely captures a hook and provides more positive self-centering. Insuring that tension from the puller or hanging hook will be coaxially directed through the locking pliers to the workpiece. A sufficiently narrow elliptical eye or an eye defining a narrowing slot will capture a clamp or other stop affixed to the cable, eliminating the need for a cumbersome hook. Additionally, the eye portion may be allowed to coaxially swivel relative to the shank.

Therefore, a primary object of the present invention is to provide a pulling system for locking pliers which will allow the exertion of coaxial tension through a set of locking pliers to a workpiece.

Another object of the present invention is to provide a convenient coupling between a pulling device and a workpiece.

Another object of the present invention is to provide a convenient means to hang workpieces for ready retrieval or storage.

Another object of the present invention is to provide a system to quickly and easily attach a cable puller or the like to an edge of a sheet metal workpiece.

Another object of the present invention is to provide a system to transmit tension through a set of locking pliers to a screw threaded into the center of a sheet metal panel allowing a cable puller or similar tool to provide slow steady tension to the panel.

Similarly, an object of the present invention is to provide a system to transmit tension through a set of locking pliers to a tab secured to the center of a sheet metal panel.

Specifically, an object of the present invention is to provide an adapter intended to replace the adjustment screw of a set of locking pliers to provide an eye to receive the hook or shackle associated with a tensioning device.

Another object of the present invention is to provide an adapter which will encourage the hook or shackle associated with a tensioning device to self center as tension is applied.

Another object of the present invention is to provide a self securing eye to receive a protrusion associated with a cable.

These and other objects and advantages of the present invention, along with features of novelty appurtenant thereto, will become apparent in the course of the following description.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
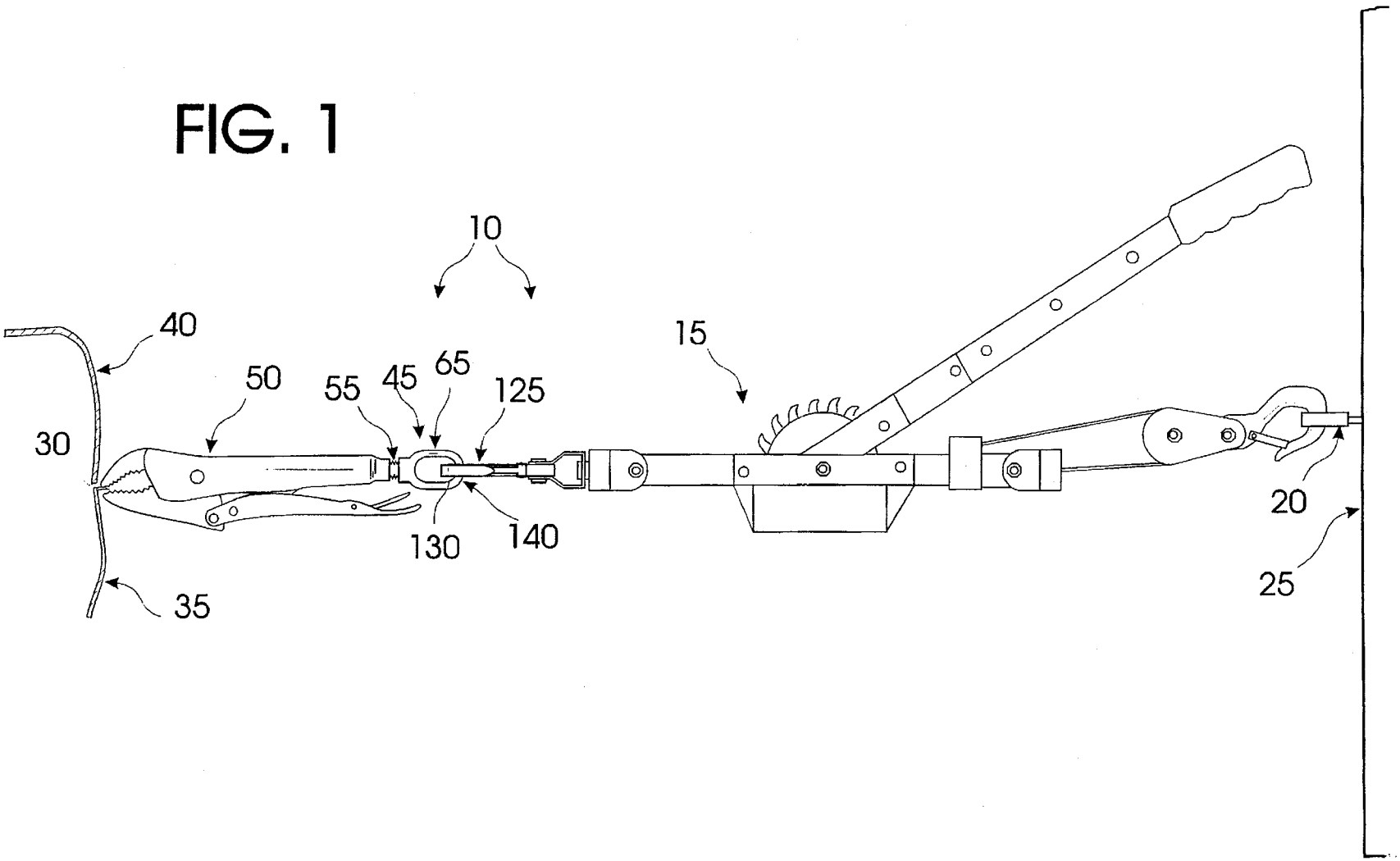
FIG. 1 is a fragmented environmental view of my Locking Pliers Pulling System in use, anchored to a wall and clamped to a sheet metal flange, pulling the sheet metal into alignment.
Figure 2:
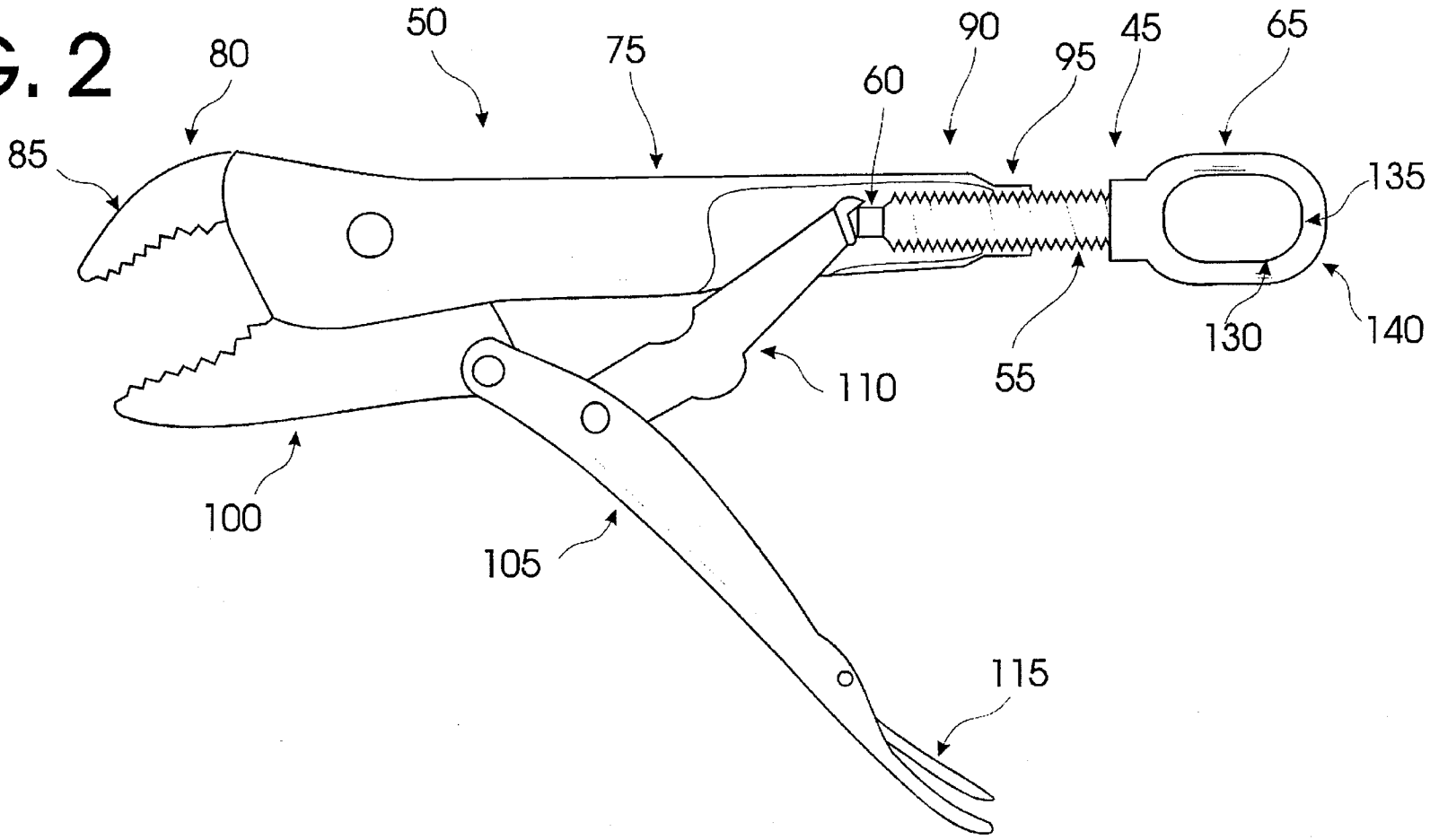
FIG. 2 is a partially fragmented side view of the preferred embodiment of my adapter deployed in a set of locking pliers.
Figure 3:
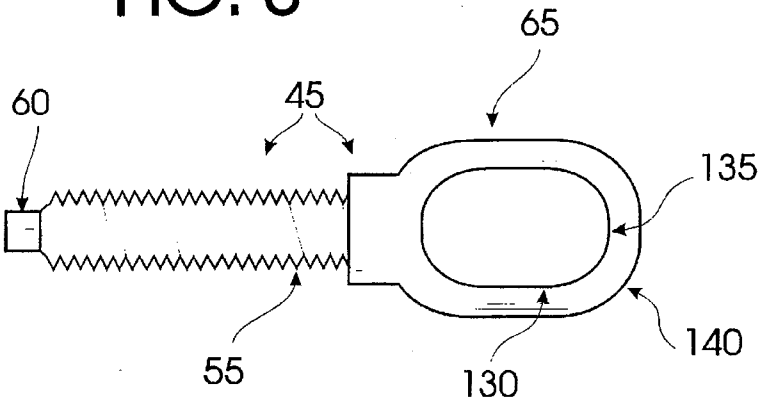
FIG. 3 is a side elevational view of the adapter.
Figure 4:
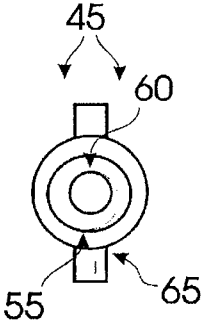
FIG. 4 is an end view of the adapter taken generally from the left of FIG. 3.
Figure 5:
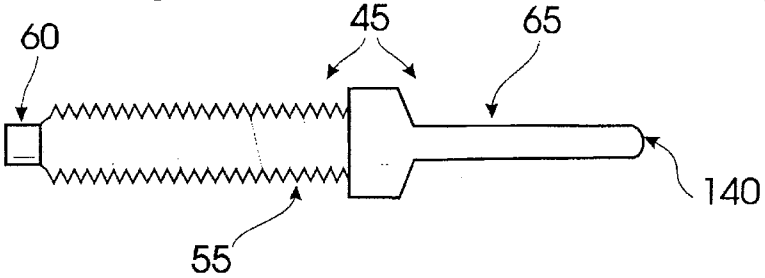
FIG. 5 is top plan view of the adapter.
Figure 6:
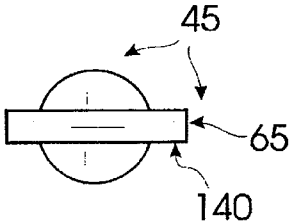
FIG. 6 is an end view of the adapter taken generally from the right of FIG. 5.

With reference now to the accompanying drawings, the preferred embodiment of my Locking Pliers pulling system is broadly designated by the reference numeral 10. My Locking Pliers pulling system 10 is comprised of a cable puller 15 or other tensioning device deployed in conjunction with a set of locking pliers 50 employing an adapter 45, as illustrated in FIG. 1. This environmental view shows the system 10 anchored to an eye 20 or the like fixed in a stable structure such as a wall 25 and clamped to a sheet metal flange 30. The cable puller 15 is used to pull the workpiece 35 into alignment with the stationary sheet metal 40. The puller adapter 45 is intended to modify a set of locking pliers 50 such as Vise-Grips®. The adapter 45 is an integral component adapted to replace the adjustment screw of a set of locking pliers 50. The adapter 45 comprises an elongated, threaded shank portion 55, a coaxial follower portion 60 and a coaxial eye portion 65. The eye portion 65 may be of various shapes to facilitate use and, may swivel relative to, but coaxially with, the shank portion 55.

Locking pliers 50 generally comprise a stationary handle 75. The distal end 80 of the stationary handle 75 defines a fixed jaw 85 and a proximal end 90 defines a hollow adjustment barrel 95. A movable jaw 100 is pivoted to the stationary handle 75 in cooperation with the fixed jaw 85. An operating handle 105 is pivoted to the movable jaw 100. The operating handle 105 is used to lock the pliers 50. A link 110 pivotally extends from the operating handle 105 into the adjustment barrel 95. A release lever 115 is pivoted to the operating handle 105 for selectively releasing the pliers 50. In some locking pliers 50 the operating handle 105 serves the function of releasing the plies as well as locking them. Conventionally, an adjustment screw, usually having a knurled knob head, is threadbly received by the adjustment barrel 95 defined in the stationary handle 75. The adjustment screw engages the link 110. The adjustment screw is used to adjust minimum separation between the jaws 85 and 100 and thus indirectly to adjust the pressure exerted by the plier jaws 85 and 100 when locked.

With attention now directed to FIGS. 2 through 6, one can see that my adapter 45 comprises an elongated, threaded shank portion 55, a coaxial follower portion 60 and a coaxial eye portion 65. The shank portion 55 is received by the adjustment barrel 95 defined in the stationary handle of a set of locking pliers 50. The follower portion 60 extends from the end of the shank 55 received within the adjustment barrel 95. The follower portion 60 engages the link 110 extending from the operating handle 105 of the pliers 50 into the adjustment barrel 95. The eye portion 65 extends from the shank portion 55 projecting from the proximal end 90 of the stationary handle of the pliers 50. The eye portion 65 is intended to receive a hook 125 or shackle associated with a pulling or tensioning mechanism 15 such as a cable puller of the type commonly referred to as a "come-along". In the preferred embodiment, the interior 130 of the eye 65 defines a generally oval opening. This shape encourages the hook 125 to self-center as tension is applied. In other words, as the puller 15 pulls upon a set of pliers 50 employing the adapter 45, the hook 125 of the puller 15 will tend to slide to the center 135 of the proximal portion 140 of the eye 65 of the adapter 45.

Figure 7:
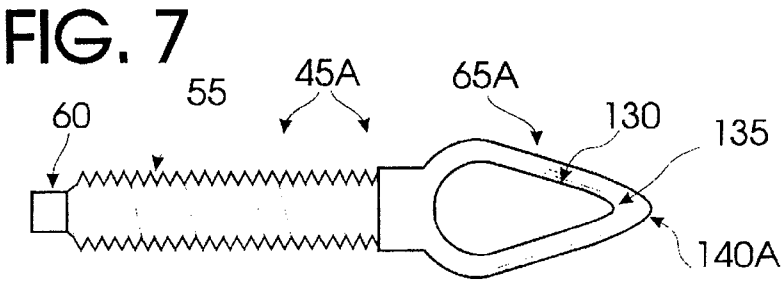
FIG. 7 is a side elevational view of a first alternative embodiment of the adapter; and, FIG. 8 is a side elevational view of a second alternative embodiment of the adapter.
Figure 8:
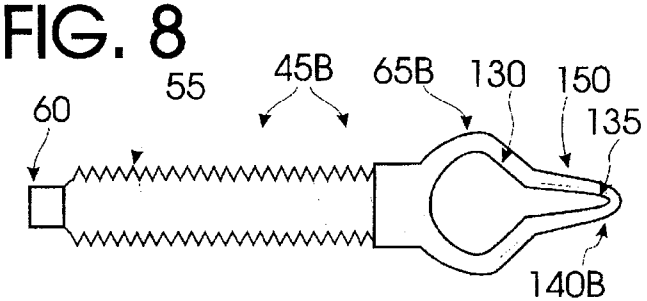

The eye 65 may be of several different shapes. For example the eye 65 may be of a regular, generally oval shape as illustrated in FIGS. 3 through 6. Alternatively the eye 65A of the adapter 45A may have an elliptical shape as illustrated in FIG. 7. An elliptical shaped eye 65A is advantageous in that it will more securely capture the hook 125 of the pulling device as more tension is applied. Even more significantly the elliptical eye 65A provides grater assurance that the hook 125 will self-center. Therefore, the tension from the puller 15 will more surely be coaxially directed to the locking pliers 50 and thusly to the workpiece 35. Additionally, a sufficiently narrow elliptical eye 65A will allow the puller 15 to catch on a clamp affixed to the cable or a similar protrusion associated with the cable, eliminating the need for a cumbersome hook 125. These latter two goals, self centering and self securing, are even more securely accomplished by an adapter 45B employing a narrowing slot 150 associated with the eye 55B as illustrated in FIG. 8.

A final alternative embodiment employs an eye 65 which is allowed to swivel on the shank 55. However, the eye 65 is maintained coaxial to the shank 55 to insure that tension from a puller 15 is coaxially transferred to the locking pliers 40.

From the foregoing, it will be seen that this invention is one well adapted to obtain all the ends and objects set forth herein, together with other inherent advantages.

It will be understood that certain features and subcombinations are of utility and may be employed without reference to other features and subcombinations. This is contemplated by and is within the scope of the claims.

As many possible embodiments may be made of the invention without departing from the scope thereof. It is to be understood that all matter herein set forth or shown in the accompanying drawings is to be interpreted as illustrative and not in a limiting sense.

What is claimed is:

1. An integral locking pliers linear puller system adapter, said adapter comprising:

a threaded, elongated shank portion adapted to threadably mate with an adjustment barrel defined by a handle of a set of locking pliers;

a coaxial follower portion extending from a first end of said shank portion for engaging an adjustment arm of said locking pliers within said adjustment barrel; and, a coaxial eye portion extending from an opposite end of said shank portion, generally aligned with said shank portion and said handle.

2. The integral adapter as defined in claim 1 wherein said eye portion is rigidly extends from said shank portion.

3. The integral adapter as defined in claim 1 wherein said eye portion defines a slot, said slot narrowing distal from said shank portion to provide centering coaxially aligned along said eye portion, said shank portion and said handle to provide centering.

4. The integral adapter as defined in claim 1 wherein said eye portion coaxially swivels relative to and generally aligned with said shank portion and said handle.

5. The integral adapter as defined in claim 3 wherein said eye portion coaxially swivels relative to and generally aligned with said shank portion and said handle.

6. A locking pliers pulling system for transferring linear tension directly to a workpiece, said system comprising:

a stationary handle comprising a distal end and a proximal end, said distal end defining a fixed jaw and said proximal end defining a hollow adjustment barrel;

a movable jaw pivotably attached to said stationary handle, between said distal and proximal ends, in cooperation with said fixed jaw;

an operating handle pivotably attached to said movable jaw;

a link pivotably extending from said operating handle and into said adjustment barrel defined in said stationary handle;

biasing and release means associated with said operating handle for releasably locking and releasing said pliers; and, an integral puller adapter threadably received by said hollow adjustment barrel said puller adapter comprising:

a threaded, elongated shank portion adapted to threadably mate with said adjustment barrel;

a coaxial follower portion extending from a first end of said shank portion for engaging said link within said adjustment barrel; and, a coaxial eye portion, extending from an opposite end of said shank portion generally aligned with said shank portion and said stationary handle.

7. The system as defined in claim 6 wherein said eye portion rigidly extends from said shank portion.

8. The system as defined in claim 6 wherein said eye portion defines a slot, said slot narrowing distal from said shank portion to provide centering coaxially aligned along said eye portion, said shank portion and said stationary handle.

9. The system as defined in claim 6 wherein said eye portion coaxially swivels relative to and generally aligned with said shank portion and said stationary handle.

10. The system as defined in claim 8 wherein said eye portion coaxially swivels relative to and generally aligned with said shank portion and said stationary handle.

11. The system as defined in claim 6 further comprising pulling means for providing linear tension to said workpiece, said pulling means linked to said eye portion, said pulling means linearly extending from said eye to an anchoring point.

12. The system as defined in claim 11 wherein said pulling means comprises a winch.

13. The system as defined in claim 11 wherein said pulling means comprises a slide hammer generally aligned along said eye portion, said shank portion and said stationary handle.

14. A locking pliers pulling system for providing linear tension directly to a workpiece, said system comprising:

a set locking pliers to be secured to said workpiece, said locking pliers comprising:

a stationary handle comprising a distal end and a proximal end, said distal end defining a fixed jaw and said proximal end defining a hollow adjustment barrel;

a movable jaw pivotably attached to said stationary handle, between said distal and proximal ends, in cooperation with said fixed jaw;

an operating handle pivotably attached to said movable jaw;

a link pivotably extending from said operating handle and into said adjustment barrel defined in said stationary handle; and, biasing and release means associated with said operating handle for releasably locking and releasing said pliers;

an integral puller adapter threadably received by said hollow adjustment barrel said puller adapter comprising:

a threaded, elongated shank portion adapted to threadably mate with said adjustment barrel;

a coaxial follower portion extending from a first end of said shank portion for engaging said link within said adjustment barrel; and, a coaxial eye portion extending from an opposite end of said shank portion, generally aligned with said shank portion and said stationary handle; and, pulling means for providing tension to said workpiece, said pulling means linked to said eye portion, said pulling means extending from said eye portion to an anchoring point.

15. The system as defined in claim 14 wherein said eye portion defines a slot, said slot narrowing distal from said shank portion to provide centering coaxially aligned along said eye portion, said shank portion and said stationary handle.

16. The system as defined in claim 15 wherein said eye portion coaxially swivels relative to and generally aligned with said shank portion and said stationary handle.

17. The system as defined in claim 14 wherein said pulling means comprises a winch.

18. The system as defined in claim 14 wherein said pulling means comprises a cable puller and said eye portion is sufficiently large to receive a hook of said cable puller.

19. The system as defined in claim 14 wherein said eye portion coaxially swivels relative to and generally aligned with said shank portion and said stationary handle.

20. The system as defined in claim 19 wherein said pulling means comprises a slide hammer generally aligned along said eye portion, said shank portion and said stationary handle.

* * * * *